United States Patent [19]

Shaffer

[11] Patent Number: 4,949,851

[45] Date of Patent: Aug. 21, 1990

[54] COLLAPSIBLE DISPLAY

[75] Inventor: Douglas E. Shaffer, Concord, N.C.

[73] Assignee: Chesapeake Display & Packaging Company, Winston-Salem, N.C.

[21] Appl. No.: 199,740

[22] Filed: May 27, 1988

[51] Int. Cl.[5] ..... A47F 5/00

[52] U.S. Cl. ..... 211/149; 211/195

[58] Field of Search ..... 211/149, 195, 201, 184, 211/73; 248/174, 459; 108/113, 111; 229/120.31; 206/45.24, 45.11

[56] References Cited

U.S. PATENT DOCUMENTS

| | | | |
|---|---|---|---|
| 901,858 | 10/1908 | Williams | 229/120.31 X |
| 957,218 | 10/1910 | Klefeker | 229/120.31 X |
| 2,088,741 | 8/1937 | Hanson | 211/184 X |
| 2,249,234 | 7/1941 | Srodulski | 211/149 X |
| 2,642,330 | 6/1953 | Armour | 211/149 X |
| 3,045,835 | 7/1962 | Hawthorne et al. | 108/111 X |
| 3,093,247 | 6/1963 | Erickson | 211/149 X |
| 4,122,782 | 10/1978 | Coombs | 211/149 X |
| 4,202,278 | 5/1980 | Wadenhed | 211/149 X |
| 4,311,100 | 1/1982 | Gardner et al. | 211/149 X |
| 4,723,664 | 2/1988 | Smith | 211/149 |
| 4,740,010 | 4/1988 | Moshouitz | 108/111 X |

*Primary Examiner*—Alvin C. Chin-Shue
*Assistant Examiner*—Sarah A. Lechok

[57] ABSTRACT

A collapsible display designed to display products and packaged goods having connected back and side walls, foldable shelves secured to the side walls, and a divider fastenable to the shelves and moveable with respect to the back wall. The divider and shelves are releasably securable to the back wall to form a freestanding display assemblable from a substantially flat, folded package when in the collapsed condition to a freestanding, multishelved product and package supporting furniture when in the assembled condition.

8 Claims, 3 Drawing Sheets

COLLAPSIBLE DISPLAY

BACKGROUND AND OBJECTIVES OF THE INVENTION

The present invention relates to displays for holding and presenting to potential purchasers products and packaged goods and, more particularly, to a freestanding collapsible display that can be disassembled in a folded and flat condition, stored in a relatively small area, and assembled to provide a multishelved, rigid freestanding fixture.

Frequently it is necessary or desirable to supplement existing and permanent store displays for holding products and packaged goods with temporary, freestanding displays that can be easily removed and stored when the need for their use has ended. Under such conditions, it is most desirable to have displays that can be quickly assembled and positioned at appropriate, high-traffic locations within a store and thereafter be easily collapsed and stored efficiently.

It is therefore a principal object of the invention to provide a collapsible display that may be produced and stored in a collapsed condition from the factory to the retailer.

Another object of the present invention is to provide a collapsible display having components of simple character which can be easily and economically mass-produced and readily assembled by anyone without requiring skill or training or expensive equipment.

These and other objects and advantages of the present invention will become more readily apparent to those skilled in the art after a consideration of the following detailed description taken in conjunction with the accompanying drawings wherein like characters of reference designate like parts throughout the several views. The embodiment shown and described herein is by way of illustration only to make the principles and practice of the invention more readily comprehensible. There is no intent to limit the invention to the specific details herein.

SUMMARY OF THE INVENTION

A collapsible display having connected back and side walls, foldable shelves secured to the side walls, a divider moveably affixed to the shelves and displaceable with respect to the back wall, means associated with the back wall, the divider, and the shelves for releasably securing the divider and the shelves to the back wall to form a freestanding display storable in a substantially flat condition and openable to a freestanding, multishelved display for sellably displaying products and consumer packaged goods.

DETAILED DESCRIPTION OF THE PREFERRED EMBODIMENT

Figure 4:
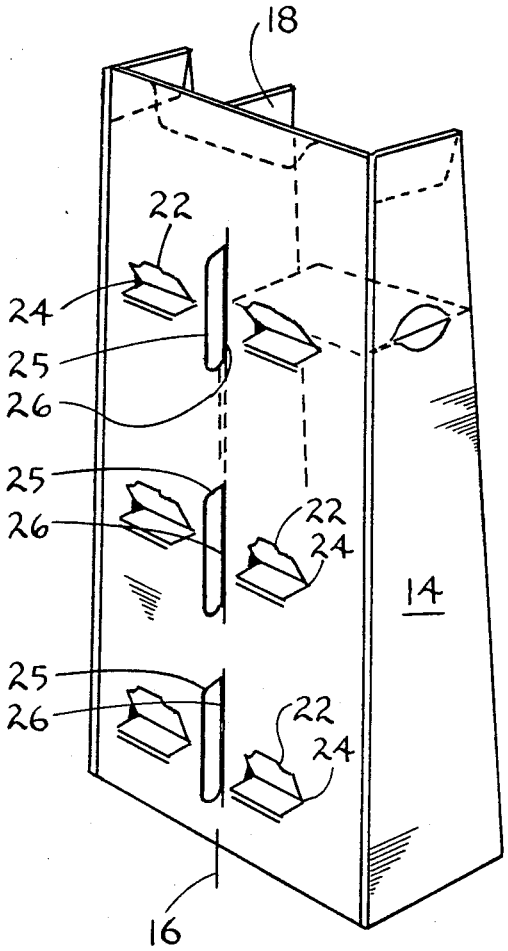
FIG. 4 is a perspective, rearward view of the collapsible display comprising the present invention showing the releasable securement of the divider and foldable shelves to the back wall.

Referring now to the drawings, the display, shown generally as 10, is formed of connected back and side walls 12, 14, preferably of an integral construction. Back wall 12 is foldable along its center line 16 as shown in FIG. 4 to facilitate storing the display when it is in a collapsed condition.

Figure 1:
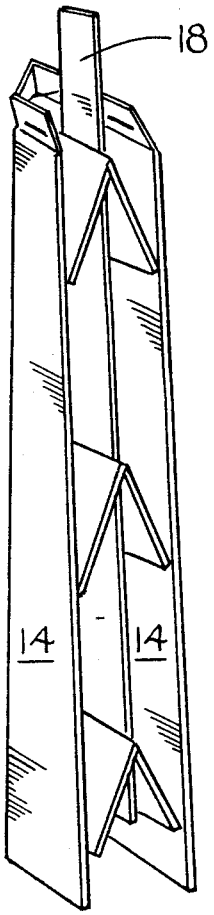
FIG. 1 is a perspective view of the collapsible display comprising the present invention showing the unit in a partially collapsed position wherein the divider is upwardly positioned between the side walls to allow the shelves to fold at their connection to the divider.
Figure 2:
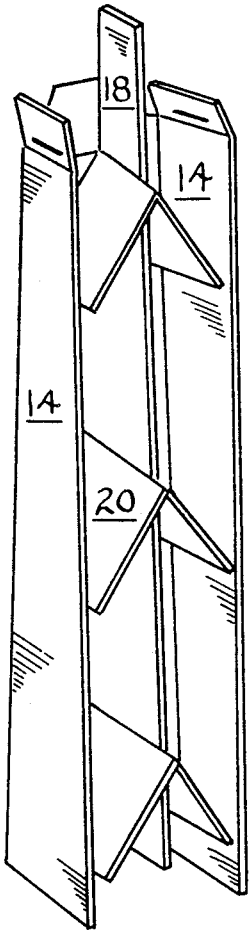
FIG. 2 is a perspective view of the collapsible display comprising the present invention moved more to the freestanding position by positioning the divider more downwardly than shown in FIG. 1 with respect to the side walls.
Figure 3:
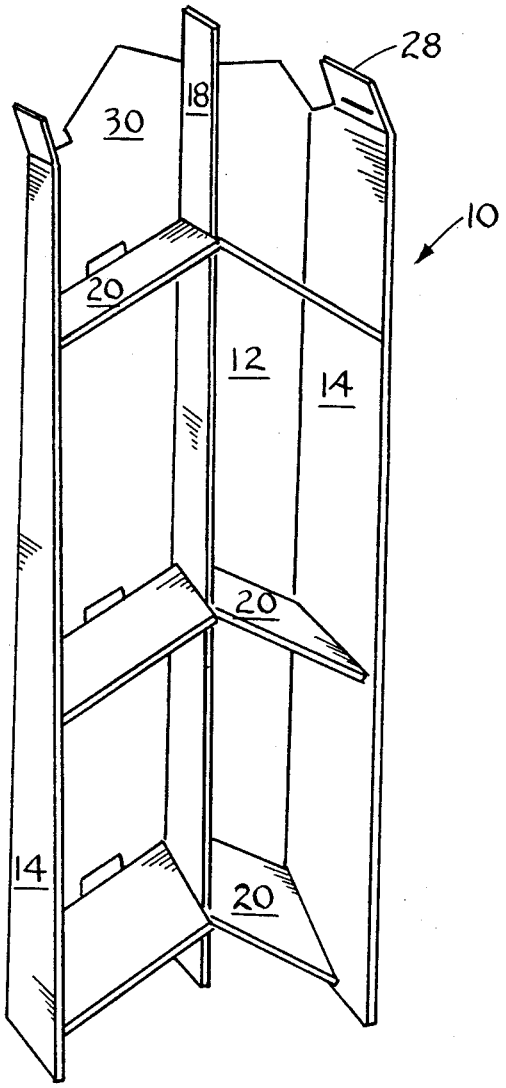
FIG. 3 is a perspective view of the collapsible display comprising the present invention wherein the display has assumed a more fully assembled position with the divider being positioned further downwardly than shown in FIG. 2 with respect to the side walls.

A divider 18 is moveably positionable in an upward direction along the center line 16 of back wall 12. Multiple shelves 20 are moveably connected to divider 18 in the manner shown in FIGS. 1, 2, and 3. Divider 18 can be moved upwardly with respect to the back and side walls to disassemble the display so that it will collapse into a substantially flat configuration with the side walls, divider, and folded back wall contiguous with each other.

Shelves 20 are provided with means to be releasably secured against back wall 12. A plurality of tabs 22 releasably received by a plurality of slots 24 in the back wall 12 functions efficiently to provide such means.

Figure 5:
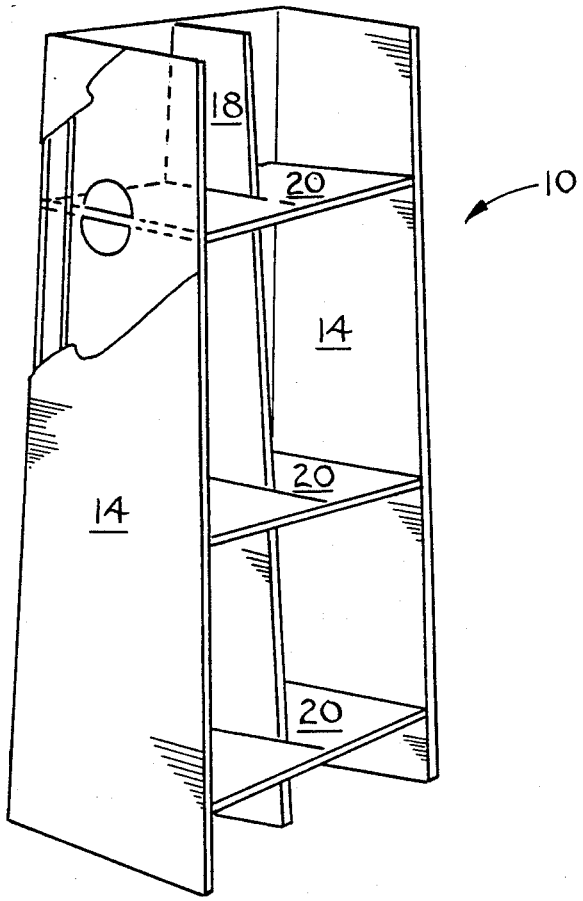
FIG. 5 is a perspective, sectional view of the collapsible display comprising the present invention showing the manner in which the foldable shelves are affixed to the side walls.

Divider 18 preferably carries some securing means to facilitate securement to back wall 12, thereby positioning shelves 20 in an appropriate position to display products and packaged goods. In a fully extended freestanding position, divider 18 rests on the floor, thereby giving shelves 20 support in the center. As shown in FIG. 4, tabs 25 extend from divider 18 through vertical slots 26 in back wall 12 so that when secured, the display assumes a fully extended freestanding position such as shown in FIGS. 4 and 5.

To dress the upper edge of the display, it is preferable to provide foldable tabs 28 adjacent side walls 14 that may be folded inwardly and downwardly (see FIG. 4). Similarly, a foldable tab 30 extends along the upper edge of back wall 12 and can be folded inwardly and downwardly to provide a smooth upper edge to the back wall 12.

This completes the description of the collapsible display comprising the present invention, the components of which it is formed, and the manner in which they are assembled. The display may be fabricated to any desirable height and width and may be designed to carry any preferred number of shelves of any width or design.

It will be obvious to those skilled in the art that the present invention need not be limited to a display but may be readily adapted for use in the making of various other articles of furniture for household or office. Such articles may include tables, desks, vanities, or the like.

It is also apparent that the display comprising the present invention may not only be easily assembled from a factory-prepared package, but may, at any time, be collapsed and reassembled at a new location.

The display, when assembled, comprises a strong, durable, rigid, and true structure, whose shelves are capable of supporting and displaying numerous articles.

Many modifications and variations of the display may be made by those skilled in the art, in accordance with the principles and practice of the invention hereinabove set forth. All such modifications and variations with respect to the disclosure herein are deemed within the spirit of the present invention and the scope of the claims hereto appended.

What is claimed is:

1. A collapsible one size display comprising: a foldable back wall and connected side walls; side wall-to-side wall foldable shelves separate and distinct from said back wall moveably affixed to said side wall; a divider moveably secured to said shelves, said divider being separate and distinct from and moveable relative to said back wall and said side walls, and said divider dividing each of said foldable shelves into separate and unconnected compartments; and means associated with said back wall and said shelves for releasably securing said shelves to said back wall to form a free standing display, said back wall being foldable as said divider and said shelves are moved upwardly with respect thereto so that said divider, said shelves, said side walls, and said foldable back wall form a flat collapsed display.

2. The display as claimed in claim 1 wherein said back wall associated means is at least one selectively positioned slot and said divider associated means is at least one selectively positioned tab contiguous said divider releasably positionable within said back wall slot to maintain said display in a fully expanded freestanding position.

3. The display as claimed in claim 1 wherein said back wall associated means are selectively positioned slots and said shelves associated means is one or more selectively positioned tabs contiguous said shelves releasably positionable within said back wall slots to maintain said display in a fully expanded freestanding position.

4. The display as claimed in claim 3 wherein said divider associated means is at least one selectively positioned tab contiguous said divider releasably positionable within said back wall slot.

5. The display as claimed in claim 1 wherein said connected back and side walls are integral.

6. The display as claimed in claim 2 wherein said tab is integral with said divider.

7. The display as claimed in claim 3 wherein said tabs are integral with said shelves.

8. The display as claimed in claim 4 wherein said connected back and side walls are integral.

* * * * *